United States Patent [19]

Megy

[11] 4,127,409

[45] Nov. 28, 1978

[54] METHOD OF REDUCING ZIRCONIUM

[75] Inventor: Joseph A. Megy, Corvallis, Oreg.

[73] Assignee: Teledyne Industries, Inc., Los Angeles, Calif.

[21] Appl. No.: 684,096

[22] Filed: May 7, 1976

Related U.S. Application Data

[63] Continuation-in-part of Ser. No. 623,325, Oct. 13, 1975.

[51] Int. Cl.[2] ..... C22B 5/04; C22B 34/14

[52] U.S. Cl. ..... 75/84.4; 75/84; 75/84.5

[58] Field of Search ..... 75/84, 84.4, 84.5

[56] References Cited

U.S. PATENT DOCUMENTS

| | | | |
|---|---|---|---|
| 2,753,256 | 7/1956 | Olson | 75/84.5 |
| 2,781,261 | 2/1957 | Kanlet | 75/84.4 X |
| 2,782,116 | 2/1957 | Spedding et al. | 75/84.4 X |
| 2,797,160 | 6/1957 | Spedding et al. | 75/84.4 X |
| 2,833,641 | 5/1958 | Wainer | 75/84.4 X |
| 2,837,426 | 6/1958 | Kanlet | 75/84.4 X |
| 2,847,299 | 8/1958 | Keller | 75/84.4 X |
| 2,849,311 | 8/1958 | Newhams | 75/84.5 X |
| 2,903,351 | 9/1959 | Spedding et al. | 75/84.4 X |
| 2,905,548 | 9/1959 | Taylor | 75/84.4 X |
| 2,913,332 | 11/1959 | Neipert et al. | 75/84.4 |
| 2,941,867 | 6/1960 | Maurer | 75/84.5 X |
| 3,000,726 | 9/1961 | Spedding et al. | 75/84.4 X |
| 3,012,877 | 12/1961 | Foos et al. | 75/84.4 |
| 3,966,458 | 6/1976 | Spink | 75/84.4 X |

*Primary Examiner*—Richard E. Schafer
*Attorney, Agent, or Firm*—Ronald W. Reagin

[57] ABSTRACT

A method for reducing zirconium is disclosed in which a reductant metal, preferably aluminum, is dissolved in the molten state in a solvent metal, preferably zinc. This molten metal phase is contacted with a fused salt phase which includes a zirconium salt to be reduced as one of its components. The desired reduction is effected by mutual displacement, with aluminum being transported from the molten metal phase to the fused salt phase, replacing zirconium in the salt, while zirconium is transported from the fused salt phase to the molten metal phase. The fused salt phase and the molten metal phase are then separated, and the solvent metal and zirconium are separated, such as by distillation.

9 Claims, 4 Drawing Figures

METHOD OF REDUCING ZIRCONIUM

This application is a continuation-in-part of application Ser. No. 623,325, filed Oct. 13, 1975.

The present invention relates to methods for reducing zirconium by a reductant metal such as aluminum which is more economical than the prior art methods.

The usual naturally occurring mineral from which zirconium is obtained is zircon, which is $ZrO_2.SiO_2$ (usually also containing about 2% $HfO_2.SiO_2$ by weight). In the usual process for obtaining zirconium in its metallic form, the zircon ore is first chlorinated to obtain $ZrCl_4$, for example, by the following reaction:

$$ZrO_2.SiO_2 + 3C + 4Cl_2 \rightarrow ZrCl_4 + SiCl_4 + 2CO + CO_2 \quad (1)$$

The zirconium tetrachloride is then reduced by a reductant metal, usually magnesium. A typical reduction reaction is as follows:

$$ZrCl_4 + 2Mg \xrightarrow{740^\circ C} Zr + 2Mg\,Cl_2 \quad (2)$$

This reduction reaction is usually effected in a Kroll furnace, in which an excess of magnesium, typically about 80% more than is needed to complete the reduction, must be provided, and in which the reaction products (zirconium, magnesium, chloride, and the excess magnesium) are mixed after the reaction, and must then be separated.

This is obviously a rather expensive method of reducing zirconium from its ore, and those skilled in the art have frequently searched for an alternate method which is both practical and less expensive. For example, since magnesium is a relatively expensive metal, the use of other less expensive reductant metals have been proposed.

One inexpensive reductant metal which has been considered is aluminum. However, if aluminum is used in the Kroll process described above, the following reaction occurs:

$$ZrCl_4 + (4/3 + x)\,Al \rightarrow 4/3\,AlCl_3 + ZrAl_x \quad (3)$$

where $ZrAl_x$ is a series of intermetallic compounds ranging from $ZrAl_3$ to $Zr_3Al$, all of which have strong intermetallic bonds. The resultant product is thus ususable for one of the primary applications of zirconium, cladding for fuel rods in nuclear reactors, because of this high aluminum contamination. A typical specification for such zirconium allows no more than 75 parts per million aluminum.

Another metallic reduction process for reducing oxides using aluminum as the reductant metal is the thermite process. Such a process is used, for example, in reducing niobium by the following reaction:

$$3Nb_2O_5 + 10Al \rightarrow 5Al_2O_3 + 6Nb \quad (4)$$

The thermite process is particularly attractive for many applications because, once the reaction is started, it generates a sufficient amount of heat to be self-sustaining. However, if the thermite process is used with zirconium, the following reaction occurs:

$$(4 + 3x)Al + 3ZrO_2 \rightarrow 2Al_2O_3 + 3ZrAl_x \quad (5)$$

Again, the zirconium-aluminum intermetallic reaction product results in this process being unusable for zirconium. Because of the known reactions described in equations (3) and (5) above, it has been widely accepted in the art that aluminum cannot be used as a reductant metal to recover zirconium. See, for example, Warren B. Blumenthal, *The Chemical Behavior of Zirconium,* which is the leading general reference on zirconium and its properties.

It is accordingly an object of the present invention to provide an improved method of reducing zirconium.

It is another object of the present invention to provide an improved method of reducing zirconium which can utilize a reductant metal such as aluminum.

It is still another object of the present invention to provide an improved method for reducing zirconium using aluminum as the reductant metal and in which the resultant zirconium is not contaminated by aluminum.

Briefly stated, and in accordance with the present invention, a method for reducing zirconium is provided in which a reductant metal, preferably aluminum, is dissolved in the molten state in a solvent metal, preferably zinc. This molten metal phase is contacted with a fused salt phase which includes a zirconium salt to be reduced as one of its components. The desired reduction is effected by mutual displacement, with aluminum being transported from the molten metal phase to the fused salt phase, replacing zirconium in the salt, while zirconium is transported from the fused salt phase to the molten metal phase. The fused salt phase and the molten metal phase are then separated, and the solvent metal and zirconium are separated, such as by distillation.

For a complete understanding of the invention, together with an appreciation of its other objects and advantages, see the following detailed description of the invention and of the attached drawings, in which:

FIG. 3 is a block diagram of a third, and the presently preferred embodiment of the invention.

Figure 1:
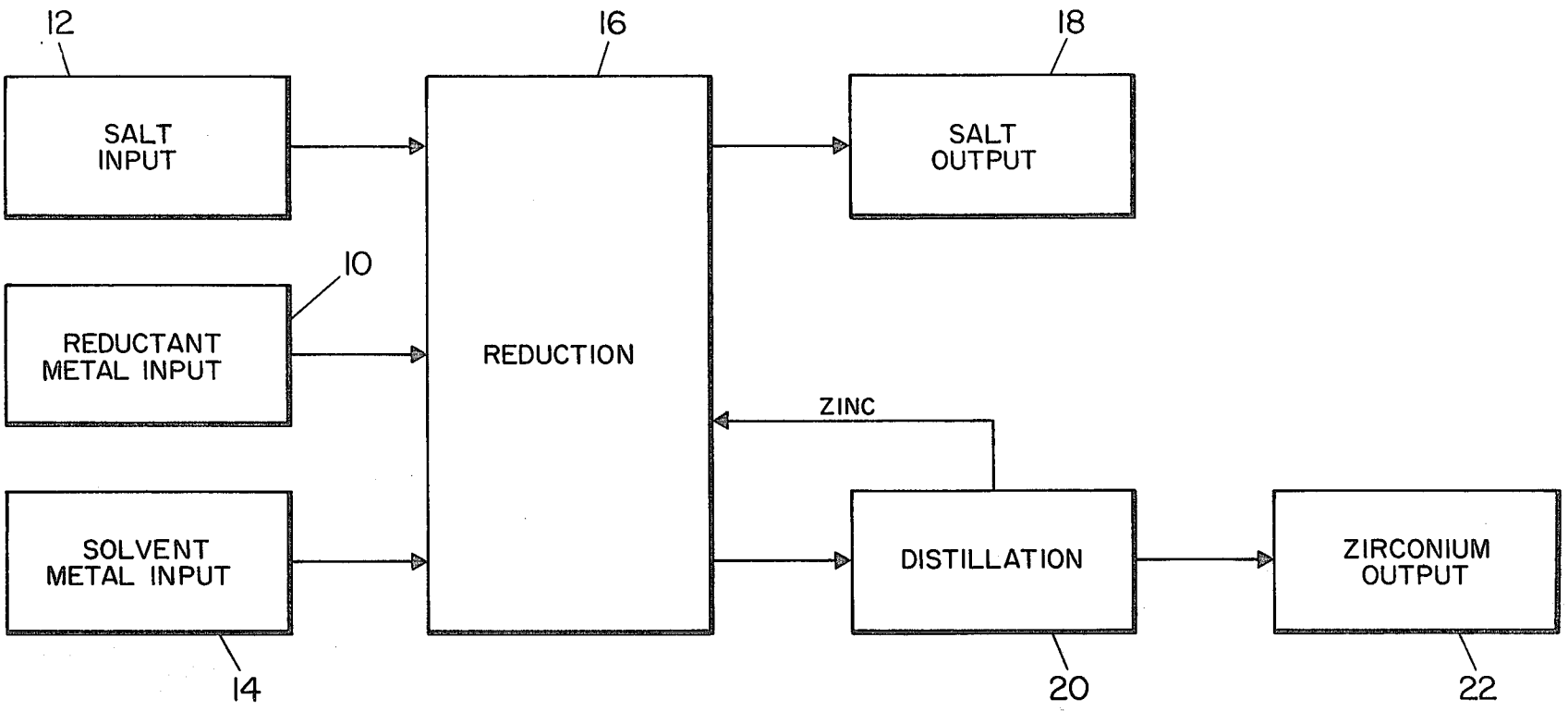
FIG. 1 is a block diagram of one emodiment of the invention, and illustrates the principles of the invention.

The present invention achieves reduction of zirconium by a reductant metal such as aluminum by mutal displacement, without the above-described problems by first dissolving the reductant metal in a suitable metal solvent prior to contacting it with the molten or fused salt which contains the zirconium ions to be reduced. The molten metal phase is then stirred vigorously with the fused salt phase to entrain the fused salt phase in the molten metal phase. It has been found that this causes the mixture to approach equilibrium in less than five minutes with sufficient agitation, and sometimes in less than one minute. The mixture is then allowed to settle, and the fused salt phase rises essentially entirely to the top of the mixture, while the molten metal phase is beneath the fused salt phase. The fused salt phase can then be poured off or siphoned off, or the molten metal phase can be removed through a suitable tap or like in the bottom of the container in which the reaction has then occurred.

If desired, the molten metal phase may again be subjected to the same process a second time to remove more of the reductant metal from the molten metal phase, and the entire proces may be repeated in as many cycles as desired to achieve the desired purity of zirconium. The solvent metal is then separated from the zirconium in any suitable maner, such as by distillation or sublimation.

The solvent metal is a metal which has the following characteristics. First, of course, it must be a metal in which both zirconium and the reductant metal are soluble to at least a significant extent. The boiling temperature of the solvent metal must be such that, in the range of operating temperatures of the reaction, both the solvent metal and the fused salt phases are in their liquid phases. The solvent metal should be a metal which is relatively easy to separate from zirconium once the reaction is complete. The solvent metal must be less electropositive than zirconium and hafnium, so that it does not replace zirconium and hafnium in the salt phase. Finally, it is preferable that the metal have the greater affinity for zirconium than it does for aluminum, so that the aluminum atoms in the metal phase are more available for reaction with the zirconium ions in the salt phase to enter into the mutual displacement reaction. In practice it has been found that the best metal for use as a solvent metal is zinc, although other metals, such as cadmium, lead, bismuth, copper, and tin may also be used as the solvent metal.

A primary characteristic of the reductant metal is that it is more electropositve than zirconium, so that it can replace zirconium in the salts, thereby reducing it to its metallic stage. Another important characteristic of the reductant metal is that it has less affinity for solvent metal, which is preferably zinc, than zirconium has for zinc, so that no alloy of the reductant metal and zirconium is formed; instead, zinc forms an alloy with zirconium and rejects the reductant metal. Also, of course, it is important that the reductant metal and the salts which it subsequently forms after the reduction reaction be liquid at the temperatures at which the reaction is occurring. The preferred reductant metal is aluminum, since, as is shown in the equations below, the objectionable aluminum-zirconium reactions described above do not occur in the method of the present invention, and thus the economies of using aluminum as a reductant metal can be realized. However, those skilled in the art will readily recognize that other reductant metals, such as magnesium sodium and calcium could also be used in a similar method.

The characteristics of the salt are as follows: First, the cation in those portions of the salt which are not a zirconium salt should be more electropositive than zirconium so that it will not be reduced by the reductant in the metal phase. Preferred cations are the alkali elements, preferably sodium and potassium, the alkaline earth elements, the rare earth elements and aluminum. The anions in the salt are preferably halides or complexes of halides and the cations given above, so that the salts are halide salts. As is explained in more detail below, the preferred halides ar chlorides and fluorides, with the advantages of each being set forth below.

As is set forth below, the zirconium salt which is present in the process is usually $ZrCl_4$ or $ZrF_4$, and by providing chloride or fluoride salts, this allows the formation of $ZrCl_x$ or $ZrF_x$ anions, whose valence is a function of x. The usual such anion formed is $ZrF_7^{---}$, $ZrCl_6^{--}$, or $ZrF_6^{--}$. These complexed anions reduce the vapor pressure of the zirconium salt to an acceptable level at the temperatures at which reduction is effected.

The melting point of the salt must be below the boiling point of the metal used as a solvent for the zirconium, in order that both the salt and the metal may be in the liquid phase at the same time. As is well known to those skilled in the art, the melting temperature of the salt, as well as the viscosity of the salt, can be changed by mixing various salts. Thus, it is frequently useful to add an additional salt such as sodium chloride to the salt phase to reduce the melting temperature of the salt and lower the viscosity of the salt.

As was noted above, it has been found that the best salts to use are either an all-chloride salt system, a chloride-fluoride mixed salt system, or an all-fuloride salt system. The all-chloride salt system has the advantage of being easier to contain. As is well known to those skilled in the art, if a fluoride is present in the fused salt phase, this can lead to difficulties in containment, since the molten fluoride tends to enter into many undesired reactions with either the container material or any other materials present in the system. The disadvantages of the all-chloride salt system is its tendency to form lower valence chlorides such as $ZrCl_2$, the tendency of $ZrCl_4$ to volatize from the salts, and also the tendency of the zinc metal to interact with the zirconium and hafnium salts and enter into the salt phase.

In contrast to this, the chloride-fluoride salt system has a low vapor pressure, very slight interaction of zinc with the salt phase, and a much reduced tendency to form lower valent zirconium compounds in the salt phase. The all-fluoride salt phase has the advantages of the chloride-fluoride salt system and can be used if a zirconium fluoride salt is made from the ore. However, in an all fluroide salt phase system, care must be taken in selecting the concentration of the salt. Aluminum-fluoride compounds are present as reaction products after the reduction reaction, and these compounds tend to be either very volatile or do not melt at the reaction temperature unless the salt system is carefully chosen.

The container in which the reaction is carried out must be carefully chosen so that it will contain the materials of the reaction at the temperatures at which the reaction is occuring, while not itself entering into the reaction. A number of different material have been tried for the container, and it has been found that the preferred containers are formed from graphite or carbon.

Having described the general parameters of the present invention, let us now consider a specific example of the use of the process to effect reduction of zirconim.

FIG. 1 shows a block diagram of a process for reducing zirconium in accordance with one embodiment of the invention. In FIG. 1, a reductant metal input 10, a salt input 12 and a solvent metal input 14 are provided to a suitable container in which the desired reduction is to be effected. The reductant metal input, of course, is preferably aluminum. This metal is provided to a reduction stage 16, along with a salt component which might be a mixture of zirconium tetrachloride, which is the zirconium compound to be reduced, and potassium chloride. Approximately ten moles of potassium chloride are used for each three moles of zirconium tetrachloride. A portion of the potassium chloride and the zirconium tetrachloride, when melted, undergoes the following reaction:

$$ZrCl_4 + 2KCl \rightarrow K_2ZrCl_6 \quad (6)$$

Typically, a sufficient amount of solvent metal, preferably zinc, is provided to the reduction stage 16 to provide approximately twelve weight percent zirconium at the conclusion of the operation. As is described below, this zinc input need only be supplied on the initial run, since thereafter it is recovered and returned to the reduction stage 16 for subsequent runs.

A typical charge to the reduction stage 16 is as follows:

TABLE 1

| Input Component | Weight |
|---|---|
| $ZrCl_4$ | 100 lb. |
| KCl | 96 lb. |
| Al | 13.9 lb. |
| Zn | 334 lb. |

The mixture is then heated to about 900° C. and is stirred vigorously to cause the now molten metal phase to entrain the now fused or molten salt phase. At this time, in accordance with the present invention, the aluminum in the metal phase reduces the zirconium in the salt phase by the following reaction:

$$4KCl + 3K_2ZrCl_6 + 4Al \xrightarrow[900^\circ C]{Zn} 4KAlCl_4 + 6KCl + 3Zr \quad (7)$$

As was noted in the description of the desired characteristic of the salt above, the excess KC1 is provided to reduce the vapor pressure of the $ZrCl_4$ at the temperatures at which the reaction occurs.

This vigorous mixing is continued for five minutes to one-half hour, and the mixture is then allowed to separate by settling, with the molten salt phase, now containing the aluminum salt, rising to the top and the molten metal phase, now containing the zirconium metal, settling to the bottom. After separation by any desired manner, the salt phase is taken to the stage 18 to recover the salt for subsequent use, if so desired.

The metal phase component is taken to a distillation stage 20, at which the zinc metal is distilled from the zirconium and is again available to be returned to the reduction stage 16 for a future reduction reaction such as is described above. Prior to such distillation, the metal phase contains the following components:

TABLE 2

| Component | Weight |
|---|---|
| Zn | 334 lb. |
| Zr | 35.2 lb. |
| Al | .035 lb |

The zirconium metal is now available at the zirconium output stage 22, and again consists of sponge metal.

Figure 2:
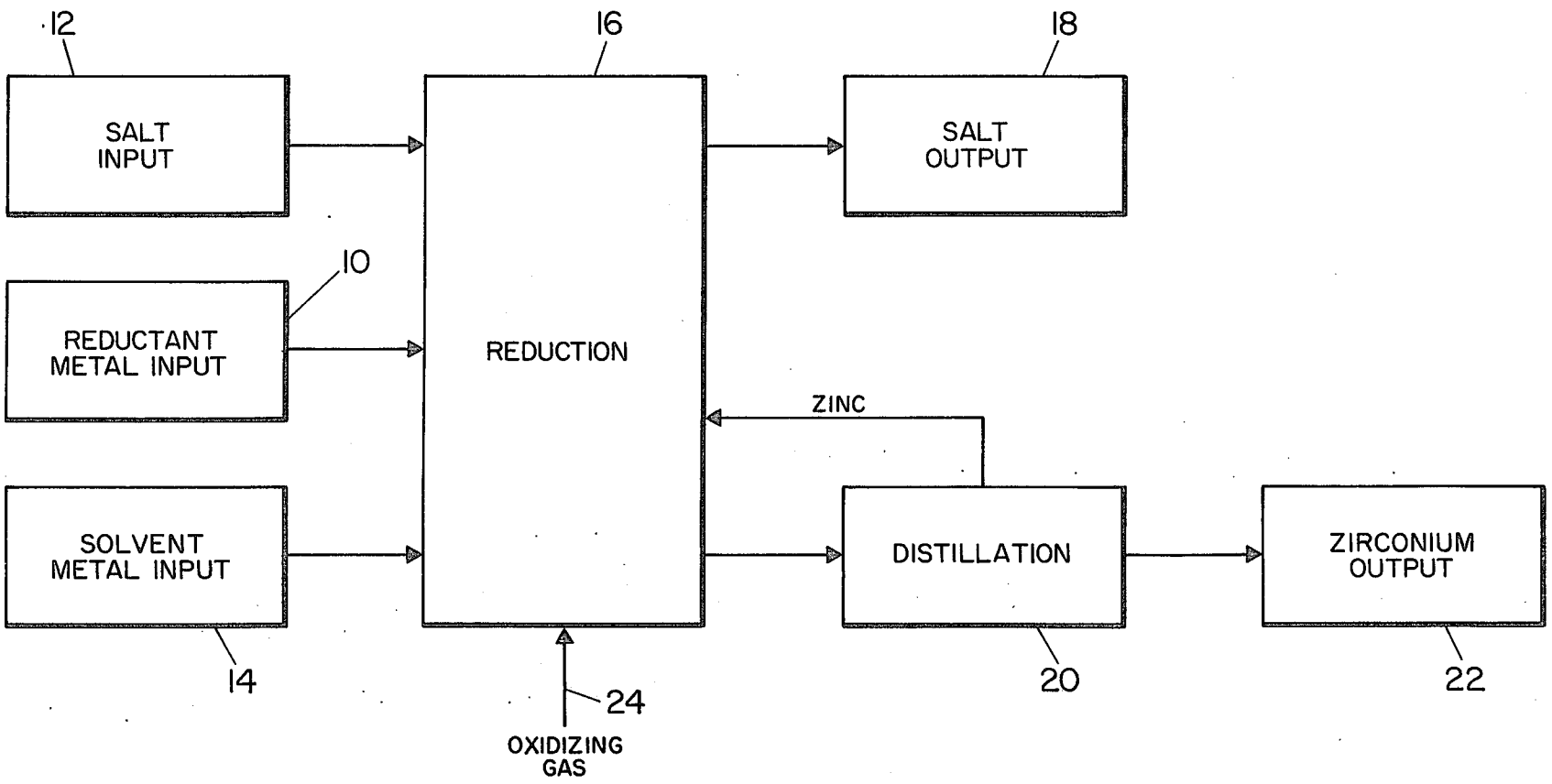
FIG. 2 is a block diagram of a second embodiment of the invention.
Figure 1:
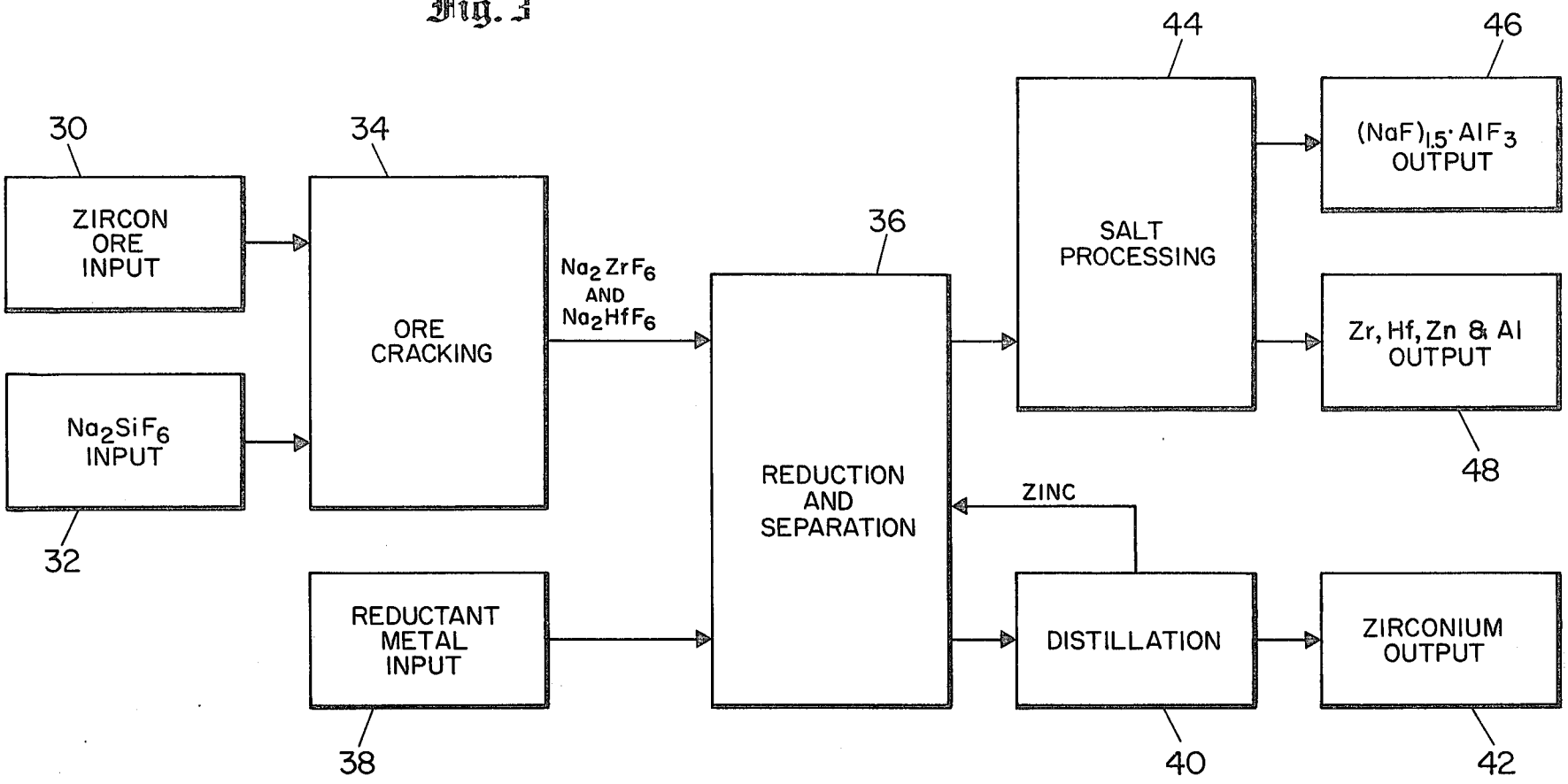

FIG. 2 shows a block diagram of a second embodiment of the present invention. The process shown in FIG. 2 is essentially the same as that shown in FIG. 1, except now, at the reduction stage 16, after the initial heating and mixing described above is completed, and after the salt phase is removed from the container in which the reduction stage 16 is effected, the metal phase is retained in the reduction stage 16 and approximately sixteen pounds of potassium chloride is added to the container. This salt-metal mixture is then again heated to approximately 900° C., and a oxidizing gas 24, such as two pounds of $Cl_2$ is passed into the metal, reacting with the zirconium and aluminum in the metal phase to form zinconium and aluminum chloride salts which are absorbed into the salt phase. The two phases are then again well mixed, and the process is completed in the manner described above. It has been found that this two-stage process results in a zirconium metal output having an aluminum content of less than 40 parts per million.

In the embodiment of FIG. 2, rather than using chloride gas as the oxidizing agent, any suitable material can be injected directly into the mixture to form a zirconium salt to provide a second stage of the desired displacement reaction to separate the aluminum from the metal phase into the salt phase. For example, zinc chloride has been successfully used, and in some instances, it is desirable to inject a zirconium salt such as zirconium tetrachloride directly into the mixture for the second stage of separation.

The foregoing description of the parameters of the present invention and the description of FIGS. 1 and 2 have illustrated the principals upon which the present invention is based. The presently preferred embodiment of the invention is a somewhat more complex process than the relatively simple processes of FIGS. 1 and 2, and comprises a complete process for obtaining zirconium in which the input material is a raw zircon ore and finished, high purity zirconium is obtained as the output product. FIG. 3 is a block diagram of that complete process, and discloses the presently preferred embodiment of the invention.

In FIG. 3, the input materials to be processed are zircon ore, which is $ZrO_2.SiO_2$ containing relatively low levels of $HfO_2.SiO_2$, and sodium silicofluoride ($Na_2SiF_6$). These inputs are represented by the blocks 30 and 32 respectively in FIG. 3. These materials are supplied to an ore cracking stage 34, in which the following reactions occur:

$$Na_2SiF_6 + ZrO_2.SiO_2 \rightarrow Na_2ZrF_6 + 2SiO_2 \quad (8)$$

$$Na_2SiF_6 + HfO_2.SiO_2 \rightarrow Na_2HfF_6 + 2SiO_2. \quad (9)$$

Typically, the ore cracking stage 34 is effected in an indirectly fired kiln at a temperature of approximately 700° C. for approximately 1 hour.

The output product is removed from the kiln, and the $Na_2ZrF_6$ and $Na_2HfF_6$ are leached from the $SiO_2$ and crystalized from the leach liquor. This is in itself a good purification step for the zirconium, and removes the zirconium from most of the other impurities which may be present in the ore other than hafnium.

The $Na_2ZrF_6$ and $Na_2HfF_6$ are then supplied to a reduction and separation stage 36, in which they are dissolved in a solvent metal such as zinc, as was described above in connection with FIGS. 1 and 2. An aluminum reductant metal input 38 is also supplied to the reduction and separation stage 36. In the reductant and separation stage 36, the zinc, aluminum and $Na_2ZrF_6$ and $Na_2HfF_6$ are heated to a temperature of approximately 900° C., at which the entire mixture is molten, and the molten liquids are stirred vigorously, as in FIGS. 1 and 2 above. At this time, the following reactions occur:

$$3Na_2ZrF_6 + 4Al \xrightarrow{Zn} 4[(NaF)_{1.5}.AlF_3] + 3Zr \quad (10)$$

$$3Na_2HfF_6 + 4Al \xrightarrow{Zn} 4[(NaF)_{1.5}.AlF_3] + 3Hf \quad (11)$$

In the preferred embodiment of the invention, approximately 85% to 95% enough aluminum to complete the above reactions is supplied to the reduction and separation stage 36, so that practically all of the aluminum present enters the salt phase and some $Na_2ZrF_6$ is left in the mixture. Now as is described in detail and calimed in the above mentioned application, Ser. No.

623,325, filed Oct. 17, 1975, any hafnium metal which was formed in accordance with equation (1) above displaces a zirconium ion in the salt by the following reaction:

$$Na_2ZrF_6 + Hf \rightarrow Na_2HfF_6 + Zr \quad (12)$$

After vigorous stirring, the mixture is allowed to settle, and the salt phase is removed from the metal phase, in the manners described above. The now separated metal phase is then again taken to a distillation phase 40, at which the zinc is distilled from the zirconium. The zinc can then be returned for reuse in the reduction and separation stage 36. Virtually pure zirconium is now available at the zirconium output 42.

The following Table 3 shoes the input materials, and output product (zirconium sponge) achieved in five typical runs in accordance with the process just described.

TABLE 3

| INPUT MATERIAL | | | | ZIRCONIUM OUTPUT |
|---|---|---|---|---|
| $Na_2ZrF_6$ | - | 85 | lb. | |
| $Na_2HfF_6$ | - | 0.7 | lb | |
| Zn | - | 230 | lb | 24.2 lb. |
| Al | - | 9.6 | lb. | |
| $Na_2ZrF_6$ | - | 85 | lb | |
| $Na_2HfF_6$ | - | 0.7 | lb. | |
| Zn | - | 231 | lb | 24.3 lb. |
| Al | - | 9.6 | lb. | |
| $Na_2ZrF_6$ | - | 85 | lb | |
| $Na_2HfF_6$ | - | 0.7 | lb. | |
| Zn | - | 236 | lb | 24.9 lb. |
| Al | - | 9.8 | lb. | |
| $Na_2ZrF_6$ | - | 85 | lb | |
| $Na_2HfF_6$ | - | 0.7 | lb. | |
| Zn | - | 235 | lb. | 24.7 lb. |
| Al | - | 9.8 | lb. | |
| $Na_2ZrF_6$ | - | 85 | lb | |
| $Na_2HfF_6$ | - | 0.7 | lb. | |
| Zn | - | 235 | lb. | 24.7 lb |
| Al | - | 9.8 | lb. | |

In accordance with another of the features of the present invention, when the salt phase is removed from the reduction and separation stage 36 after completion of the reactions described above, it is taken to a salt processing stage 44 At this time, the salt phase is again a mixture of $(NaF)_{1.5}.AlF_3$, $Na_2ZrF_6$ and $Na_2HfF_6$, but is considerably richer in hafnium than was the input salt to the reduction and separation stage 36. At the salt processing stage 44, these salts are again melted and mixed with a molten zinc bath, and a reductant metal such as aluminum is again provided to the bath. Now, however, in contrast with the reduction and separation stage 36 described above, a sufficient amount of aluminum is provided to complete the reactions of equations (10) and (11) above for the entire salt phase. After this reaction is completed, the now virtually pure molten $(NaF)_{1.5}.AlF_3$ is removed from the molten metal phase, and these materials are provided at the outputs 46 and 48 respectively of FIG. 3.

The salt $(NaF)_{1.5}.AlF_3$, which may be termed a pseudocryolite, is itself a desirable product which can be sold to the aluminum industry, and thus the only salt by-product of the process of FIG. 3 is itself useful, and not a waste product. Similarly, in the metals output 48, the zinc can again be distilled off and reused in the process, leaving only the hafnium, zirconium and slight amounts of aluminum as output metals from this part of the process. If desired, these metals may be returned to the reduction and separation stage 36 to further extract any zirconium in this metal. In any event, in a typical such process, the amount of output metal left at the stage 48 is only approximately 5% of the available metals which was in the zircon ore at the input stage 30.

If even higher separation factors of zirconium from aluminum and hafnium are desired, in the embodiment of FIG. 3, the reduction and separation stage 36 may also be "fluxed" in the manner described in FIG. 2 above. If this is desired, the presently preferred manner to do this is to inject a quantity of $ZnF_2$ into the zinc-zirconium molten metal after the salt phase has been removed from the metal phase. At this time, the following reaction occurs:

$$2ZnF_2 + Zr \rightarrow ZrF_4 + 2Zn \quad (13)$$

The zirconium tetrafluoride so formed then reacts with any remaining aluminum and hafnium in the metallic phase in accordance with the following equation:

$$ZrF_4 + Hf \rightarrow HfF_4 + Zr \quad (14)$$

If this second stage of separation is desired, it is the presently preferred practice to provide enough zinc fluoride to oxidize about 2% of the zirconium in the metal phase. Thus, in the quantities given in the examples of Table 3 above, it is preferred to use about 1.1 lbs of $ZnF_2$ for this fluxing operation, if it is to be effected. If an excess of $ZnF_2$ is provided, it results in a higher aluminum and hafnium removal, but at the expense of a loss of a greater amount of zirconium. Similarly, if less $ZnF_2$ is used, a lower hafnium removal is achieved, but a greater quantity of zirconium remains in the metallic phase.

It is noted that, in contrast to the processes described in FIGS. 1 and 2 above, in the presently preferred embodiment described in FIG. 3, no excess salt such as potassium chloride, or sodium fluoride is provided into the reaction at the separation stage. As was described above, the embodiment of FIG. 3 results in the formation of the pseudo cryolite salt $(NaF)_{1.5}.AlF_3$. If an excess of sodium fluoride were provided in this pase of the reaction, the resultant salt would be ordinary cryolite, or $(NaF)_3.AlF_3$, which does not melt until a temperature of 1000° C., which is above the boiling temperature of the zinc-zirconium metal mixture.

Those skilled in the art will further recognize that the embodiment of FIG. 3 also reduces hafnium metal from a hafnium compound in the same manner as zirconium is reduced. Thus, the method can be used to reduce hafnium, and is a superior reduction method than the prior art methods of reducing hafnium.

Figure 4:
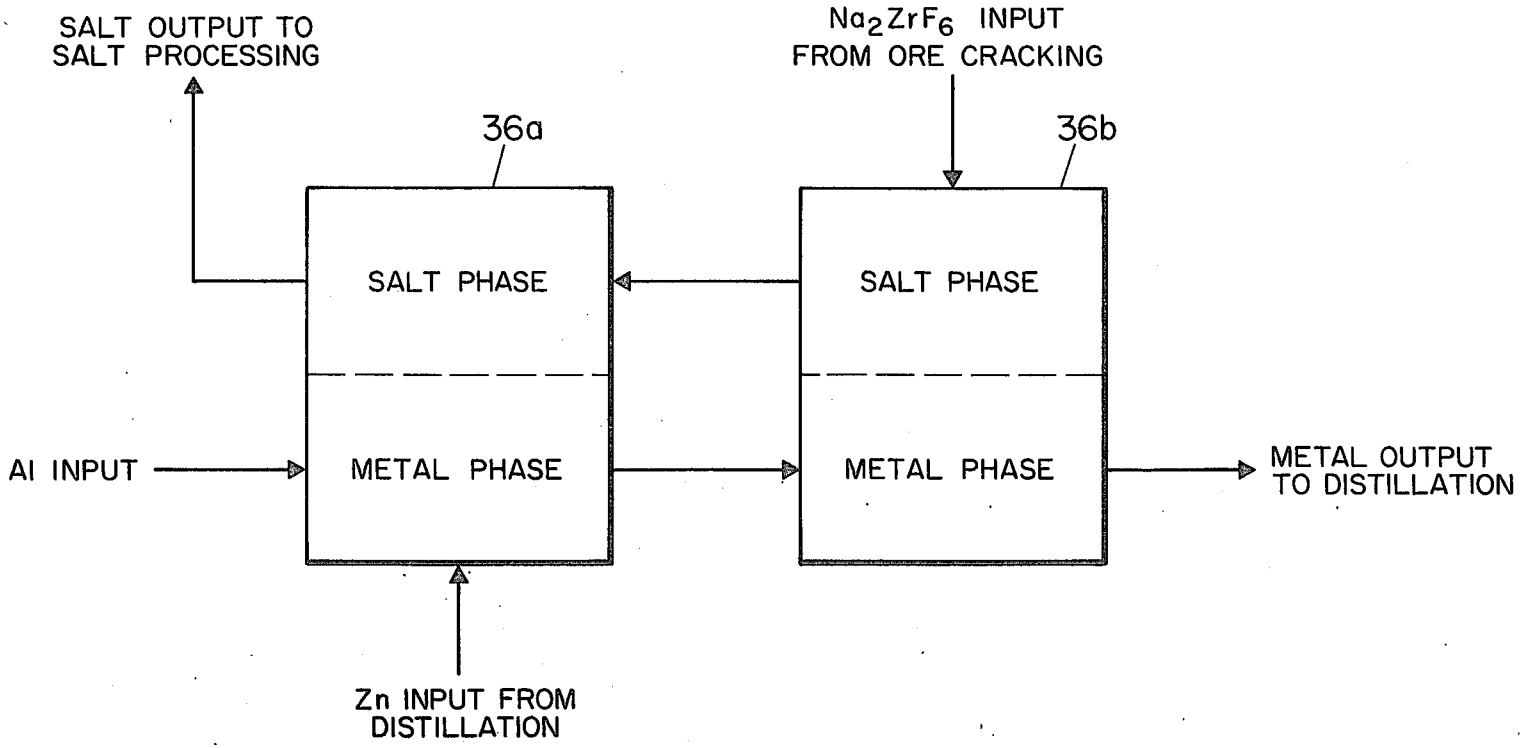
FIG. 4 is a block diagram of a modification of a portion of the embodiment of FIG. 3.

FIG. 4 is a block diagram of a modification of the method of FIG. 3, and shows a two stage counter-current reduction process to reduce the levels of aluminum and hafnium even lower in the zirconium.

In FIG. 4, the reduction and separation stage 36 is divided into two stages, designated **36*a* and 36*b*. In an initial run, first stage 36*a* is supplied an initial charge of $Na_2ZrF_6$, also containing $Na_2HfF_6$, aluninum and zinc, and the reaction occurs as described in FIG. 3 above. After the reaction is completed, the salt output is taken to the salt processing stage 44, described above, and the metal phase is taken to the second stage 36*b*** of the reduction and separation stage.

The metal phase at this point might typically contain about 1000 to 1500 parts per million aluminum and 500 parts per million hafnium (both expressed as a function of zirconium only). These levels are too high for nuclear grade zirconium. In second stage **36*b*, the metal phase is mixed with the salt input from ore cracking stage 34**, and the mixture is again heated to about 900° C. and stirred vigorously. At this time, the following reactions again occur:

$$Na_2ZrF_6 + Hf \rightarrow Na_2HfF_6 + Zr \quad (15)$$

and $$3Na_2ZrF_6 + 4Al \rightarrow 4[(NaF)_{1.5}.AlF_3] + 3Zr \quad (16)$$

These reactions at this time reduce the levels of both hafnium and aluminum in the metal phase to less than 100 parts per million, again expressed as a function of zirconium only. Now, the mixture is allowed to settle and is separated, as before. The metal phase is taken to the distillation stage 40, where the zinc is distilled off and returned to the first stage **36*a* of the reduction and separation stage, and the new high purity zirconium is taken to the zirconium output stage 42. The salt phase (which was hardly changed in second stage 36*b*, since only low levels of hafnium and aluninum were available there to react with the $Na_2ZrF_6$) is taken to the first stage 36*a*** of the reduction and separation stage, where new aluminum and zinc from the distillation stage area again provided.

Thus this modification of the process, which may now be termed a two stage counter-current reduction and separation process, provides high purity zirconium without the use of the fluxing step described in FIG. 2 above.

While the invention is thus disclosed and several embodiments are described in detail, it is not intended that the invention be limited to these shown embodiments. Instead, many modifications will occur to those skilled in the art which lie within the spirit and scope of the invention. It is thus intended that the invention be limited in scope only by the appended claims.

What is claimed is:

1. The method of producing nuclear grade zirconium from a zirconium compound, comprising the steps of:

preparing a fused salt phase including the zirconium compound to be reduced, and contacting the fused salt phase with a molten metal phase which comprises aluminum and zinc, whereby the zirconium compound is reduced by the aluminum, with the aluminum being transported from the molten metal phase to the fused salt phase while zirconium is transported from the fused salt phase to the molten metal phase.

2. The method of claim 1 which further comprises the steps of separating the molten metal phase from the fused salt phase and then separating the zinc from the zirconium.

3. The method of claim 1 in which the zirconium compound is $Na_2ZrF_6$.

4. The method of claim 3 in which a sufficient quantity of aluminum is used to reduce the zirconium in from 85% to 95% of the $Na_2ZrF_6$.

5. The method of claim 4 which further comprises the steps of again placing the fused salt phase after it is separated from the molten metal phase into a second molten metal phase which comprises aluminum and zinc, and which contains enough aluminum to reduce all of the zirconium in the $Na_2ZrF_6$ to obtain virtually pure $(NaF)_{1.5}.AlF_3$ and then separating the $(NaF)_{1.5}.AlF_3$ from the second molten metal phase.

6. The method of claim 1 in which the fused salt phase contains salts other than the zirconium compound whose cations are alkali elements.

7. The method of claim 1 in which the fused salt phase contains salts other than the zirconium compound which are halide salts.

8. The method of claim 1 which further comprises the steps of separating the molten metal phase from the fused salt phase, contacting the molten metal phase with a second fused salt phase including the zirconium compound to be reduced, separating the molten metal phase from the second fused salt phase, and then separating the zinc from the zirconium.

9. The method of claim 8 further comprises the steps of contacting the second fused salt phase, after it has been separated from the molten metal phase, with a second molten metal phase which comprises aluminum and zinc.

* * * * *